US011495393B2

(12) United States Patent
Jung et al.

(10) Patent No.: US 11,495,393 B2
(45) Date of Patent: Nov. 8, 2022

(54) COIL COMPONENT

(71) Applicant: SAMSUNG ELECTRO-MECHANICS CO., LTD., Suwon-si (KR)

(72) Inventors: Jung Hyuk Jung, Suwon-si (KR); Sung Min Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 365 days.

(21) Appl. No.: 16/877,905

(22) Filed: May 19, 2020

(65) Prior Publication Data

US 2021/0134515 A1 May 6, 2021

(30) Foreign Application Priority Data

Oct. 31, 2019 (KR) ..... 10-2019-0137554

(51) Int. Cl.
*H01F 27/28* (2006.01)
*H01F 17/00* (2006.01)

(52) U.S. Cl.
CPC ..... *H01F 27/2804* (2013.01); *H01F 17/0013* (2013.01); *H01F 27/2852* (2013.01)

(58) Field of Classification Search
CPC ..... H01P 27/2801; H01P 17/0013; H01F 27/2852
See application file for complete search history.

(56) References Cited

U.S. PATENT DOCUMENTS

2014/0145906 A1* 5/2014 Kato ..... H01Q 7/00 343/867
2016/0078986 A1 3/2016 Yoon et al.
2016/0086720 A1 3/2016 Jeong
2016/0217917 A1 7/2016 Jeong
(Continued)

FOREIGN PATENT DOCUMENTS

JP 2017147321 A * 8/2017
KR 10-2016-0032580 A 3/2016
(Continued)

OTHER PUBLICATIONS

Office Action issued in corresponding Korean Patent Application No. 10-2019-0137554 dated Sep. 18, 2020, with English translation.

*Primary Examiner* — Dinh T Le
(74) *Attorney, Agent, or Firm* — Morgan, Lewis & Bockius LLP

(57) ABSTRACT

A coil component includes coil portions spaced apart from each other; and a body having a first core and a second core, spaced apart from the first core, wherein the coil portions include a first coiled portion and a second coiled portion that form at least one turn about the first and second cores, respectively, and a first extension portion and a second extension portion extending from the first and second coiled portions, respectively, and each surround the first and second cores. The body further comprises spacing portions, facing each other, defined between the coiled portions and spaced apart from the first and second cores. In the first and second extension portions, a line width of each of adjacent regions adjacent to the spacing portions is greater than a line width of a region except the adjacent regions.

20 Claims, 8 Drawing Sheets

(56) References Cited

U.S. PATENT DOCUMENTS

| | | | |
|---|---|---|---|
| 2018/0218830 | A1 | 8/2018 | Nakanishi et al. |
| 2019/0115143 | A1 | 4/2019 | Tachibana et al. |
| 2019/0221356 | A1 | 7/2019 | Bong et al. |

FOREIGN PATENT DOCUMENTS

| | | | |
|---|---|---|---|
| KR | 10-2016-0033462 | A | 3/2016 |
| KR | 10-2016-0092674 | A | 8/2016 |
| KR | 10-2019-0042458 | A | 4/2019 |
| KR | 10-2019-0087829 | A | 7/2019 |

* cited by examiner

COIL COMPONENT

CROSS-REFERENCE TO RELATED APPLICATION(S)

The present application claims the benefit of priority to Korean Patent Application No. 10-2019-0137554 filed on Oct. 31, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

With higher performance and smaller sizes gradually implemented in the electronic devices, the number of electronic components used in the electronic devices increases and becomes smaller.

Accordingly, there is an increasing demand for a coupled coil component to reduce a mounting area of components. In order to increase efficiency of the components within the same size, mutual inductance may be increased to raise a coupling coefficient thereof, or leakage inductance may be increased to appropriately lower a coupling coefficient thereof. For example, in accordance with to the needs of those skilled in the art, a shape of a coil portion of a coupled inductor may be appropriately modified to control the mutual inductance and the leakage inductance, to appropriately adjust the coupling coefficients.

Meanwhile, when a plurality of coil portions in a variety of forms are arranged in a single coil component, a separation space between the plurality of coil portions may occur. Since the separation space between the coil portions may be relatively narrow such that it is difficult to fill a magnetic material or introduce plating liquid for forming the coil portions thereinto, a problem of deteriorating characteristics of the coil components in total may occur.

SUMMARY

An aspect of the present disclosure is to provide a coil component capable of effectively controlling coupling inductance between a plurality of coil portions in a coupled inductor.

Another aspect of the present disclosure is to provide a coil component having improved DC resistance characteristics by increasing an area occupied by a plurality of coil portions between the plurality of coil portions in a coupled inductor.

According to an aspect of the present disclosure, a coil component includes a support substrate; a first coil portion and a second coil portion arranged on the support substrate and spaced apart from each other; and a body having a first core and a second core, spaced apart from the first core, wherein the first and second coil portions include a first coiled portion and a second coiled portion that include at least one turn about the first and second cores, respectively, and a first extension portion and a second extension portion extending from the first and second coiled portions, respectively, the first and second extension portions surrounding the first and second cores. The body further comprises spacing portions, facing each other, defined between the first coiled portion and the second coiled portion and spaced apart from the first and second cores. In the first and second extension portions, a line width of each of adjacent regions adjacent to the spacing portions is greater than a line width of a region except the adjacent regions.

According to another aspect of the present disclosure, a coil component includes a support substrate; a first coil portion and a second coil portion arranged on the support substrate and spaced apart from each other; and a body having a first core and a second core, spaced apart from the first core, wherein the first and second coil portions include a first coiled portion and a second coiled portion that include at least one turn about the first and second cores, respectively, and a first extension portion and a second extension portion extending from the first and second coiled portions, respectively, the first and second extension portions surrounding the first and second cores. Each of the first and second coil portions includes first and second coil layers disposed on one surface of the support substrate, the first and second coil layers sequentially disposed from the one surface of the support substrate. A line width of the first and second extension portions at a center region thereof in the first direction is greater than a line width of the first and second extension portions at a region except the center region. Aline width of the second coil layer at the center region is greater than a line width of the first coil layer at the center region.

According to still another aspect of the present disclosure, a coil component includes a support substrate; a first coil portion and a second coil portion arranged on the support substrate and spaced apart from each other; and a body having a first core and a second core, spaced apart from the first core, wherein the first and second coil portions include a first coiled portion and a second coiled portion that include at least one turnabout the first and second cores, respectively, and a first extension portion and a second extension portion extending from the first and second coiled portions, respectively, the first and second extension portions surrounding the first and second cores. Each of the first and second coil portions includes first and second coil layers disposed on one surface of the support substrate, the first and second coil layers sequentially disposed from the one surface of the support substrate. A line width of the first and second extension portions at a center region thereof in the first direction is greater than a line width of the first and second extension portions at a region except the center region. A line width of the second coil layer at the center region is substantially same as a line width of the first coil layer at the center region.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
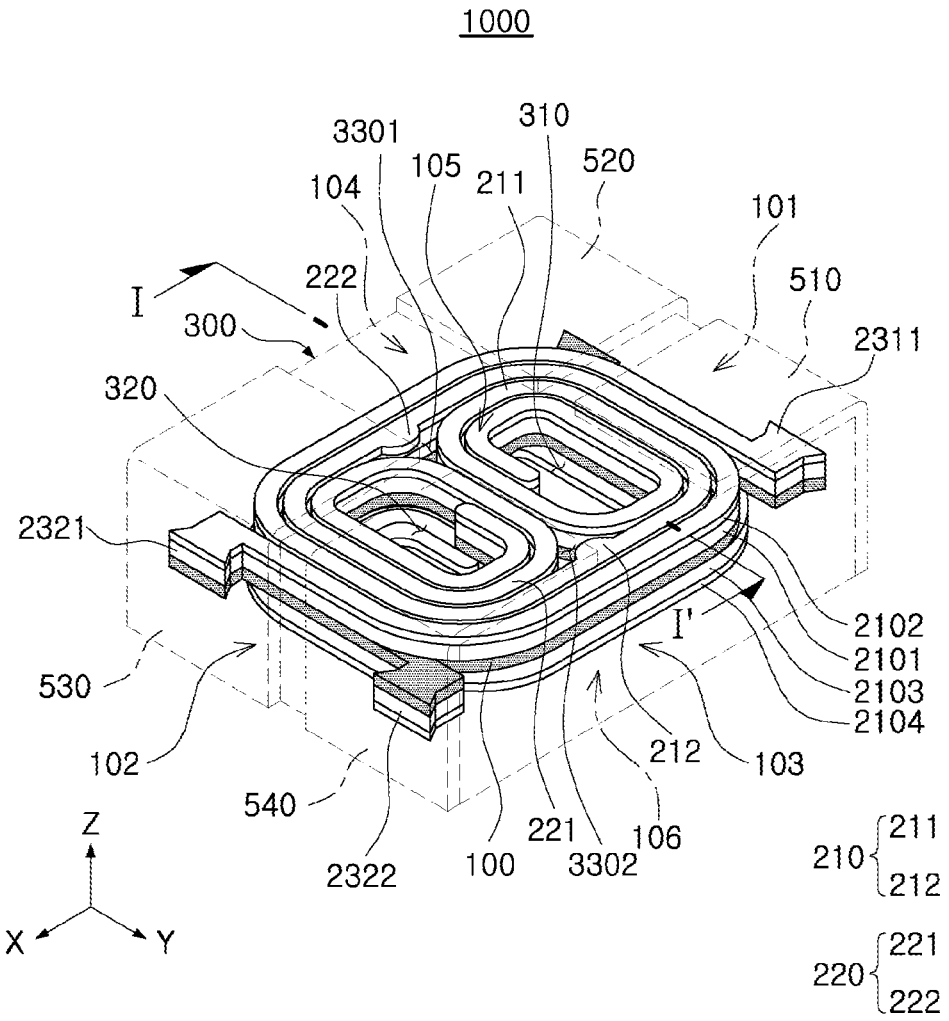
FIG. 1 is a side perspective view schematically illustrating a coil component according to a first exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an X direction is a first direction or a length direction, a Y direction is a second direction or a width direction, and a Z direction is a third direction or a thickness direction.

A value used to describe a parameter such as a 1-D dimension of an element including, but not limited to, "length," "width," "thickness," "diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
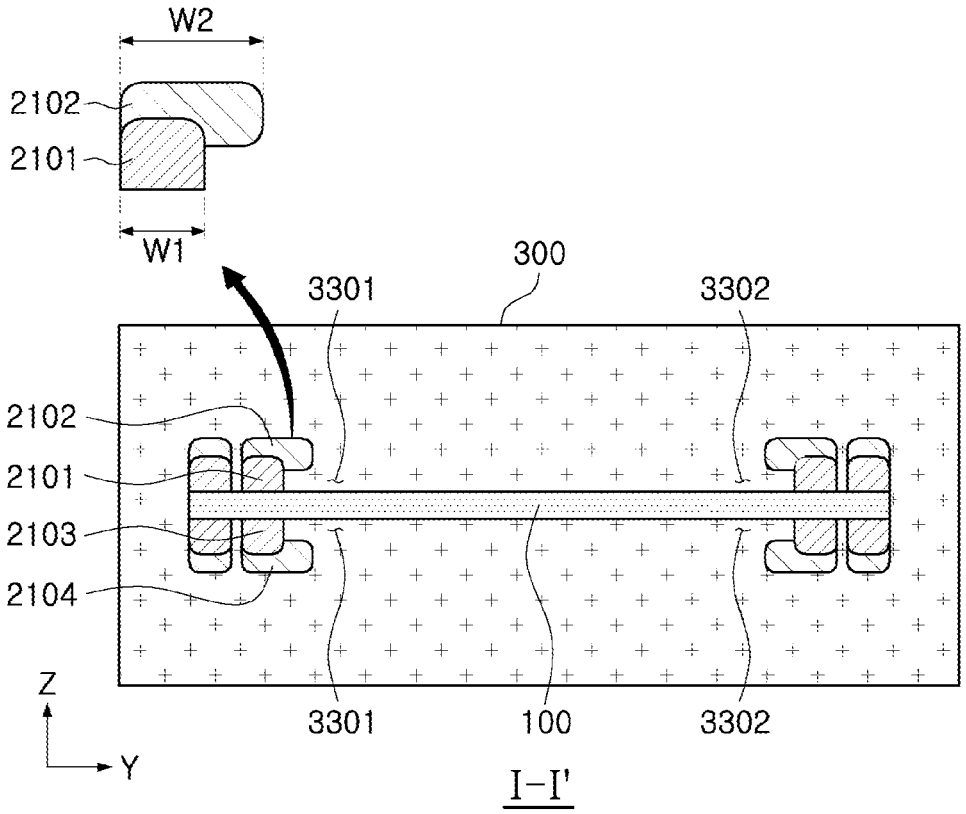
FIG. 2 is a cross-sectional view taken along line I-I' of FIG. 1.

FIG. 1 is a side perspective view schematically illustrating a coil component according to a first exemplary embodiment of the present disclosure. FIG. 2 is a cross-sectional view taken along line I-I' of FIG. 1. FIGS. 3A to 4B are views schematically illustrating the coil portion of FIG. 1.

Referring to FIGS. 1 to 4B, a coil component 1000 according to an exemplary embodiment of the present disclosure may include a support substrate 100, first and second coil portions 210 and 220, and a body 300.

The support substrate 100 may be embedded in the body 300 to be described later, and may be disposed to be spaced apart from the body 300 in the body 300. The support substrate 100 may include one surface and the other surface opposing the one surface, and may support the first and second coil portions 210 and 220 to be described later.

The support substrate 100 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 100 may be formed of an insulating material such as prepreg, Ajinomoto Build-up Film (ABF), FR-4, a bismaleimide triazine (BT) resin, a photoimageable dielectric (PID), and the like, but is not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 100 is formed of an insulating material including a reinforcing material, the support substrate 100 may provide better rigidity. When the support substrate 100 is formed of an insulating material not containing glass fibers, the support substrate 100 may be advantageous for reducing a thickness of the overall first and second coil portions 210 and 220. When the support substrate 100 is formed of an insulating material containing a photosensitive insulating resin, the number of processes for forming the first and second coil portions 210 and 220 may be reduced. Therefore, it may be advantageous in reducing production costs, and a fine via may be formed.

The body 300 may form an exterior of the coil component 1000 according to this embodiment, and may embed the first and second coil portions 210 and 220 therein.

The body 300 may be formed to have a hexahedral shape overall.

Referring to FIG. 1, the body 300 may include a first surface 101 and a second surface 102 opposing each other in a length direction X, a third surface 103 and a fourth surface 104 opposing each other in a width direction Y, and a fifth surface 105 and a sixth surface 106 opposing each other in a thickness direction Z. In this embodiment, the fifth surface 105 and the sixth surface 106 of the body 300 may refer to one surface and the other surface of the body 300, respectively, and the first surface 101 and the second surface 102 of the body 300 may refer to one side surface and the other side surface of the body 300, respectively.

The body 300 may include first and second cores 310 and 320 passing through the first and second coil portions 210 and 220 to be described later and spaced apart from each other. The first and second cores 310 and 320 may be formed by filling a magnetic composite sheet with through-holes of the first and second coil portions 210 and 220, but is not limited thereto.

The body 300 may further include spacing portions 3301 and 3302 arranged to face each other between first and second coiled portions 211 and 221, which will be described later, and spaced apart from the first and second cores 310 and 320. The spacing portions 3301 and 3302 may include a first spacing portion 3301 surrounded by the first coiled portion 211, the second coiled portion 221, and a second extension portion 222, and a second spacing portion 3302 surrounded by the first coiled portion 211, the second coiled portion 221, and a first extension portion 212. For example, the spacing portions 3301 and 3302 may refer to a space spaced apart between the plurality of coil portions 210 and 220 in a coupled inductor that arranges the plurality of coil portions 210 and 220 in various forms in a single coil component.

The body 300 may include a magnetic material and a resin. Specifically, the body 300 may be formed by stacking at least one magnetic composite sheet including the resin and the magnetic material dispersed in the resin, and then curing the magnetic composite sheet. The body 300 may have a structure other than the structure in which the magnetic material may be dispersed in the resin. For example, the body 300 may be made of a magnetic material such as ferrite.

The magnetic material may be, for example, a ferrite powder particle or a metal magnetic powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic material may be amorphous or crystalline. For example, the metal magnetic powder particle may be a Fe—Si—B—Cr-based amorphous alloy powder, but is not limited thereto.

The ferrite powder and the metal magnetic powder particle may have an average diameter of about 0.1 μm to 30 μm, respectively, but are not limited thereto.

The body 300 may include two or more types of magnetic materials dispersed in a resin. In this case, the term "different types of magnetic material" means that the magnetic materials dispersed in the resin are distinguished from each other by average diameter, composition, crystallinity, and a shape.

The resin may include an epoxy, a polyimide, a liquid crystal polymer, or the like, in a single form or in combined forms, but is not limited thereto.

The first and second coil portions 210 and 220 may be arranged on the support substrate 100 to be spaced apart from each other, to express characteristics of the coil component.

The first and second coil portions 210 and 220 applied to this embodiment may include first and second coiled portions 211 and 221, first and second extension portions 212 and 222, first to fourth coil layers 2101, 2102, 2103, and 2104, and first and second lead-out portions 231 and 232.

Figure 3A:
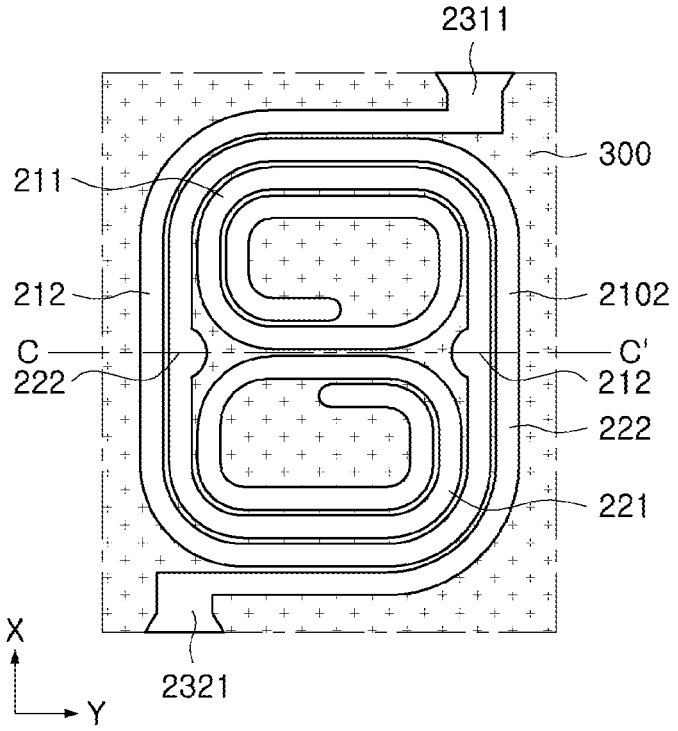
FIGS. 3A, 3B, 4A and 4B are views schematically illustrating the coil portion of FIG. 1.

Referring to FIGS. 3A to 4B, the first and second coil portions 210 and 220 may include the first coiled portion 211 and the second coiled portion 221 that form at least one turn about the first and second cores 310 and 320, respectively, and the first extension portion 212 and the second extension portion 222 extending from the first and second coiled portions 211 and 221, respectively, and each surrounding the first and second cores 310 and 320. Referring to FIGS. 1, 3A and 3B, the first extension portion 212 may connect the first lead-out portion 231 and the first coiled portion 211 to surround the first and second coiled portions 211 and 221. The second extension portion 222 may connect the second lead-out portion 232 and the second coiled portion 221 to surround the first and second coiled portions 211 and 221. Referring to FIGS. 3A to 4B, a center line C-C' may be an arbitrary reference line parallel to the width direction Y of the body 300 and passing through both the first and second spacing portions 3301 and 3302. For example, the first extension portion 212 may refer to a region of the coil portions 210 and 220, which is coiled to surround the first and second coiled portions 211 and 221 sequentially from the first lead-out portion 231 to be described later, to reach the center line C-C'. The second extension portion 222 may refer to a region of the coil portions 210 and 220, which is coiled to surround the first and second coiled portions 211 and 221 sequentially from the second lead-out portion 232 to be described later, to reach the center line C-C'. As a result, the first extension portion 212 sequentially coiled around the first and second coiled portions 211 and 221, and the second extension portion sequentially coiled around the second and first coiled portions 221 and 211 may be alternately arranged.

Referring to FIGS. 1 and 3A to 4B, the first and second coil portions 210 and 220 may include a plurality of straight portions and a plurality of curved portions connecting the plurality of straight portions to each other. In this embodiment, the curved portion may refer to a corner section in which coiling directions of the coil portions 210 and 220 are switched, and the straight portion may refer to a straight section connecting the corner section. Although not illustrated in detail, the first and second extension portions 212 and 222 may have four curved portions in each corner section and four straight portions connecting the curved portions. Similarly, the first and second coiled portions 211 and 221 also have four curved portions in each corner section and four straight portions connecting the curved portions. As such, since the first and second coil portions 210 and 220 have curved portions, the spacing portions 3301 and 3302 may be formed between the first and second coil portions 210 and 220. The spacing portions 3301 and 3302 may be arranged between the curved portion of the first coiled portion 211 and the curved portion of the second coiled portion 221.

Figure 3B:
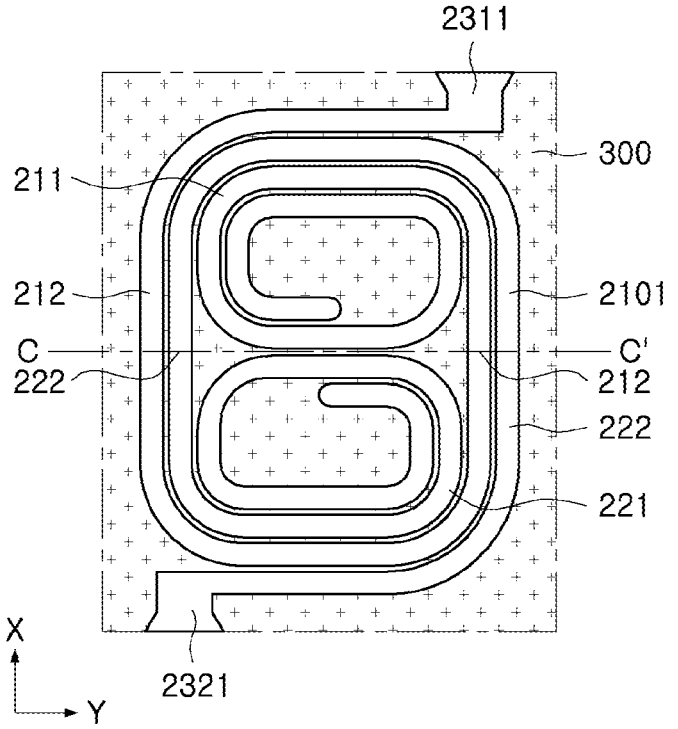
Figure 4A:
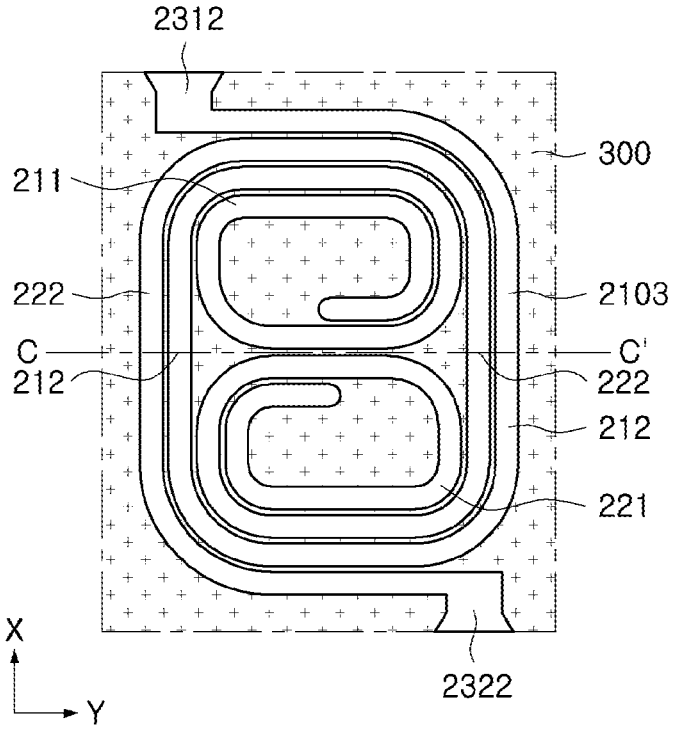
Figure 4B:
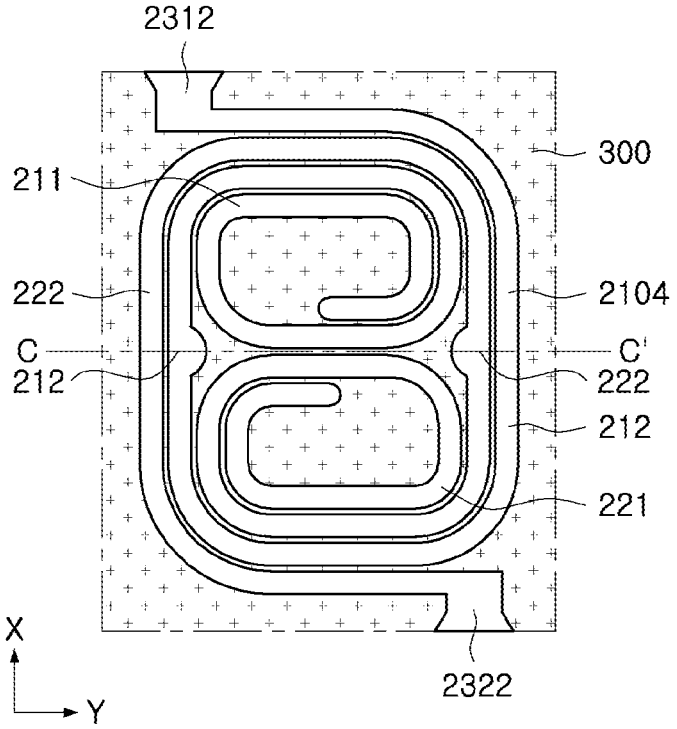

Referring to FIGS. 3A and 3B, the first and second coil portions 210 and 220 may include a first coil layer 2101 disposed on the one surface of the support substrate 100, and a second coil layer 2102 disposed on the first coil layer 2101 and contacting the first coil layer 2101. Referring to FIGS. 4A and 4B, a third coil layer 2103 disposed on the other surface of the support substrate 100 and a fourth coil layer 2104 disposed on the third coil layer 2103 and contacting the third coil layer 2103 may be included.

Referring to FIGS. 1 to 4B, in each of adjacent regions in the first and second extension portions 212 and 222, adjacent to the spacing portions 3101 and 3102, a line width (W2) of each of the second and fourth coil layers 2102 and 2104 may be greater than a line width (W1) of each of the first and third coil layers 2101 and 2103. In this embodiment, first resists (not illustrated) for forming the first and second coil portions 210 and 220 may be arranged to be spaced apart from the support substrate 100, and the first coil layer 2101 of the first and second coil portions 210 and 220 may be formed between the first resists (not illustrated). Thereafter, the first resists (not illustrated) may be removed by exposure/development. In this embodiment, the second coil layer 2102 of the first and second coil portions 210 and 220 may be formed on a side portion of the first coil layer 2101 without separately disposing a second resist. In this case, the first coil layer 2101 may be formed by an isotropic plating process and the second coil layer 2102 may be formed by an anisotropic plating process, to form the second coil layer 2102 having the line width (W2), greater than the line width (W1) of the first coil layer 2101. For example, since the second coil layer 2102 is formed by the anisotropic plating process, in each of the adjacent regions in the first and second extension portions 212 and 222, adjacent to the spacing portions 3101 and 3102, a line width of the second coil layer 2102 may be greater than a thickness of the second coil layer 2102. In addition, since the second resist is not disposed separately, a height of a region in the first extension portion 212, adjacent to the first spacing portion 3301, may be identical to a height of a region in the second extension portion 222, adjacent to the first spacing portion 3301. Similarly, a height of a region in the first extension portion 212, adjacent to the second spacing portion 3302, may be identical to a height of a region in the second extension portion 222, adjacent to the second spacing portion 3302. In this embodiment, for convenience of description, only the first and second coil layers 2101 and 2102 may be described. Similarly, the third and fourth coil layers 2103 and 2104, respectively corresponding to the first and second coil layers 2101 and 2102, may be applied.

In one example, the line width (W2) may refer to a maximum line width of the second coil layer 2102 adjacent to one of the spacing portions 3301 and 3302 in a cross-sectional view of the coil component in a width-thickness direction (e.g., Y-Z direction), and the line width (W1) may refer to a maximum line width of the first coil layer 2101 adjacent to one of the spacing portions 3301 and 3302 in the cross-sectional view of the coil component in the width-thickness direction.

In the related art, since spaces spaced between the coil portions 210 and 220 may be significantly narrow to fill the magnetic material or to inflow of the plating liquid for forming the coil portions 210 and 220, there may be a problem that characteristics of the coil component in total are deteriorated. In particular, since the inflow of the plating liquid for forming the coil portions 210 and 220 may be insufficient, growths of the coil portions 210 and 220 in height and width directions, in a region adjacent to the spacing portions 3301 and 3302, may be lowered, to generate a problem that DC resistance characteristics decrease. Therefore, in this embodiment, an area occupied by the coil portions 210 and 220 between the plurality of coil portions 210 and 220 may be increased by the above-described process to improve characteristics of the coil component 1000. Referring to FIGS. 1 and 2, the line width (W2) of each of the adjacent regions in the first and second extension portions 212 and 222, adjacent to the spacing portions 3101 and 3102, may be greater than a line width of a region in the first and second extension portions 212 and 222, except the adjacent regions. Specifically, the line width (W2) of the second coil layer 2102, adjacent to the first spacing portion 3301 of the second extension portion 222, may be greater than the line width (W1) of the first coil layer 2101, adjacent to the first spacing portion 3301 of the second extension portion 222. As a result, each of the adjacent regions in the first and second extension portions 212 and 222, adjacent to the spacing portions 3101 and 3102, may have a shape protruding toward a central portion of the body 300. Specifically, the second coil layer 2102, adjacent to the first spacing portion 3301 of the second extension portion 222, may have a shape protruding toward a central portion of the body 300. In addition, referring to FIG. 2, a height of a region in the first extension portion 212, adjacent to the first spacing portion 3301, and a height of a region in the second extension portion 222, adjacent to the first spacing portion 3301, may be the same. As such, an area occupied by the coil portions 210 and 220 in the spacing portions 3301 and 3302 between the coil portions 210 and 220 may be increased to improve DC resistance characteristics in the same components.

All dimensions described in the specification and indicated in the drawings may be measured by a standard method that will be apparent to and understood by one of ordinary skill in the art.

Referring to FIGS. 1 and 3A to 4B, the first coil portion 210 may further include a first lead-out portion 231 exposed through the first surface 101 of the body 300, and the second coil portion 220 may further include a second lead-out portion 232 exposed through the second surface 102 of the body 300. Referring to FIGS. 1 and 3A to 4B, the first extension portion 211 may connect the first coil portion 210 and the first lead-out portion 231, and the second extension portion 222 may connect the second coil portion 220 and the second lead-out portion 232. In addition, the first lead-out portion 231 may include first and second lead-out patterns 2311 and 2312 exposed through the first surface 101 of the body 300 to be spaced apart from each other, and the second lead-out portion 232 may include third and fourth lead-out patterns 2321 and 2322 exposed through the second surface 102 of the body 300 to be spaced apart from each other.

The first and second coil layers 2101 and 2102 and the third and fourth coil layers 2103 and 2104 may be connected by vias (not illustrated), respectively.

The coil portions 210 and 220 and the vias (not illustrated) may include at least one conductive layer.

For example, when the first and second coil portions 210 and 220 and the vias (not illustrated) are formed on the one surface of the support substrate 100 by a plating process, the first and second coil portions 210 and 220 and the vias (not illustrated) may include a seed layer, such as an electroless plating layer or the like, and an electroplating layer, respectively. In this case, the electroplating layer may have a single layer structure or a multilayer structure. The electroplating layer of the multilayer structure may be formed in a conformal film structure in which one electroplating layer may be covered by the other electroplating layer, and may be only formed in a structure in which the other electroplating layer is stacked on one surface of anyone electroplating layer. The seed layers of the first and second coil portions 210 and 220 and the seed layers of the vias (not illustrated) may be integrally formed so as not to form a boundary therebetween, but are not limited thereto. The electroplating layers of the first and second coil portions 210 and 220 and the electroplating layers of the vias (not illustrated) may be integrally formed so as not to form a boundary therebetween, but are not limited thereto.

Each of the first and second coil portions 210 and 220, and the vias (not illustrated) may be formed of a conductive material such as copper (Cu), aluminum (Al), silver (Ag), tin (Sn), gold (Au), nickel (Ni), lead (Pb), titanium (Ti), chromium (Cr), or alloys thereof, but is not limited thereto.

First to fourth external electrodes 510, 520, 530, and 540 may be arranged outside the body 300, and may be connected to the first and second lead-out portions 231 and 232, respectively. Referring to FIG. 1, the first and second external electrodes 510 and 520 may be arranged outside the body 300, and may be connected to the first lead-out portion 231, respectively, and the third and fourth external electrodes 530 and 540 may be arranged outside the body 300, and may be connected to the second lead-out portions 232, respectively. In detail, the first and second external electrodes 510 and 520 may be respectively connected to the first and second lead-out patterns 2311 and 2312, disposed on the first surface 101 of the body 300, and the third and fourth external electrodes 530 and 540 may be respectively connected to the third and fourth lead-out patterns 2321 and 2322, disposed on the second surface 102 of the body 300.

In this embodiment, the first to fourth external electrodes 510, 520, 530, and 540 may be formed by forming first an insulating layer (not illustrated) on a surface of the body 300, except for a region in which the first to fourth external electrodes 510, 520, 530, and 540, and, then, placing the first to fourth external electrodes 510, 520, 530, and 540 in a region, other than a region in which the insulating layer (not illustrated) is disposed.

The first to fourth external electrodes 510, 520, 530, and 540 may be formed by using a paste including a metal having excellent electrical conductivity. For example, a conductive paste containing nickel (Ni), copper (Cu), tin (Sn), silver (Ag), or the like, as a single component, alloys thereof, or the like may be included. In addition, a plating layer may be further formed on each of the first to fourth external electrodes 510, 520, 530, and 540. In this case, the plating layer may include any one or more selected from the group consisting of nickel (Ni), copper (Cu), and tin (Sn). For example, a nickel (Ni) layer and a tin (Sn) layer may be sequentially formed.

Second Embodiment

Figure 5:
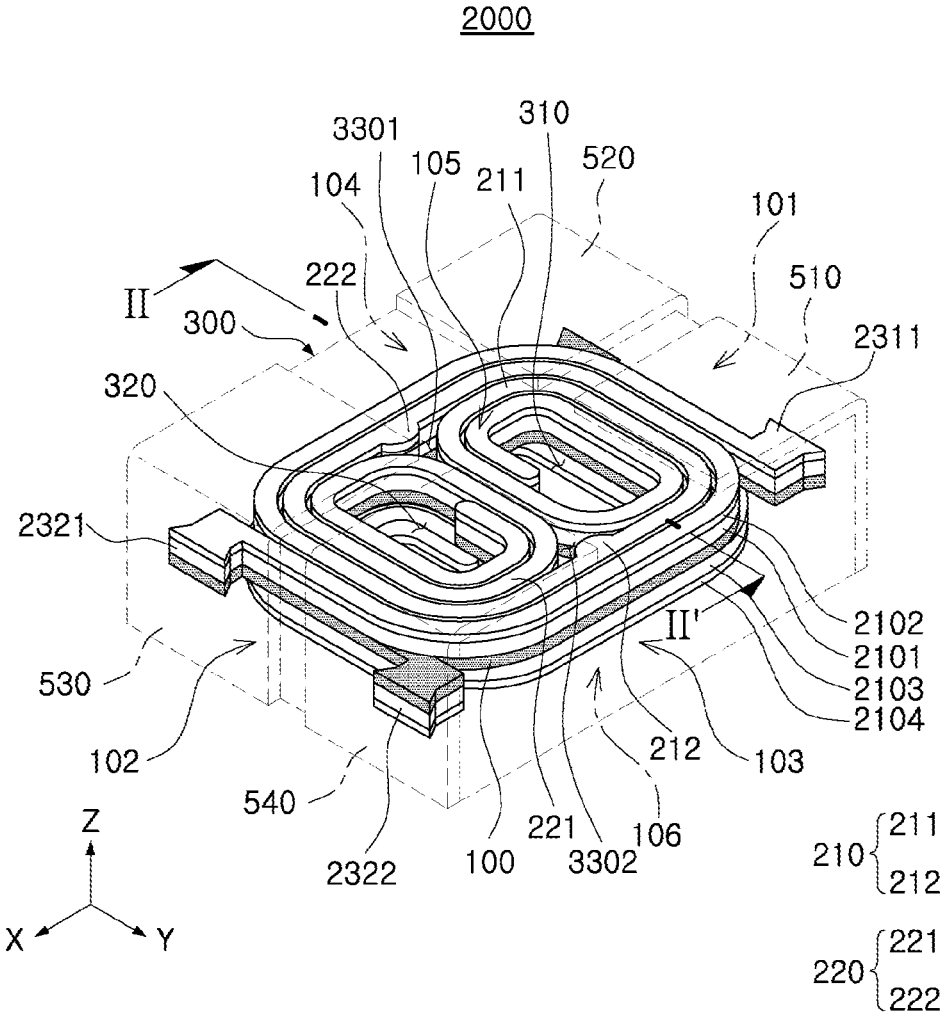
FIG. 5 is a side perspective view schematically illustrating a coil component according to a second exemplary embodiment of the present disclosure.
Figure 6:
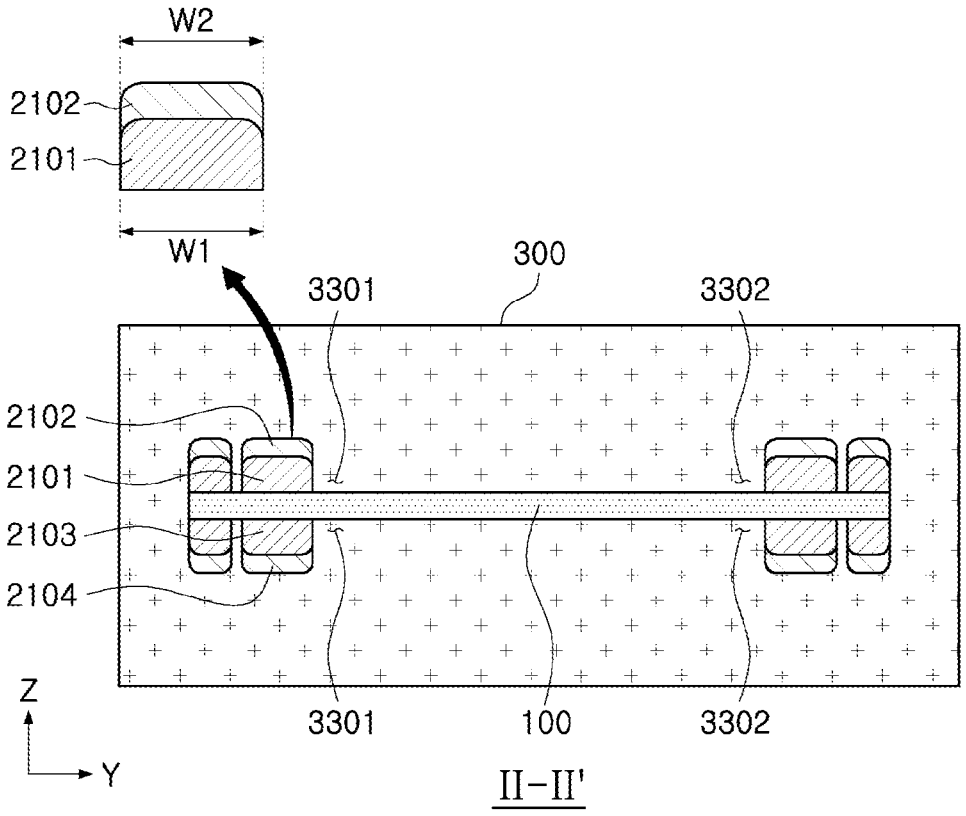
FIG. 6 is a cross-sectional view taken along line II-II' of FIG. 5.
Figure 7A:
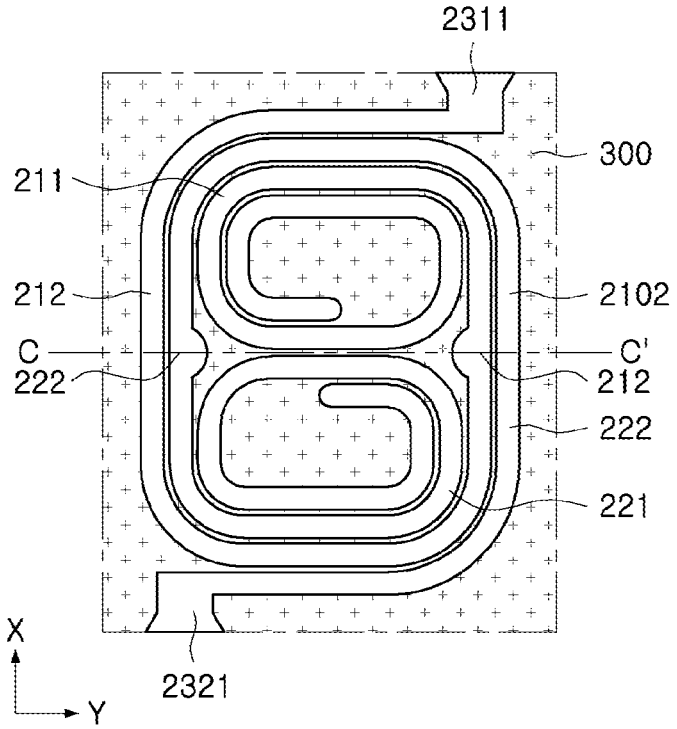
FIGS. 7A, 7B, 8A and 8B are views schematically illustrating the coil portion of FIG. 5.
Figure 7B:
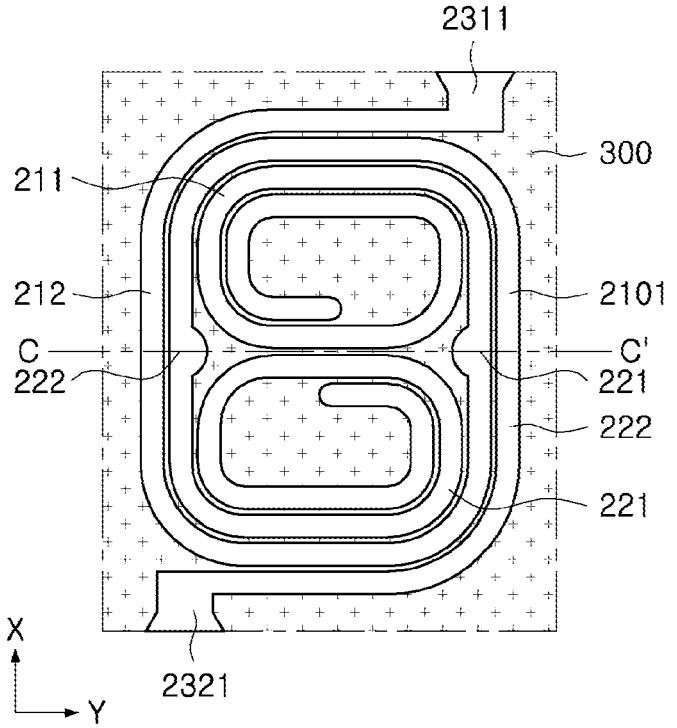
Figure 8A:
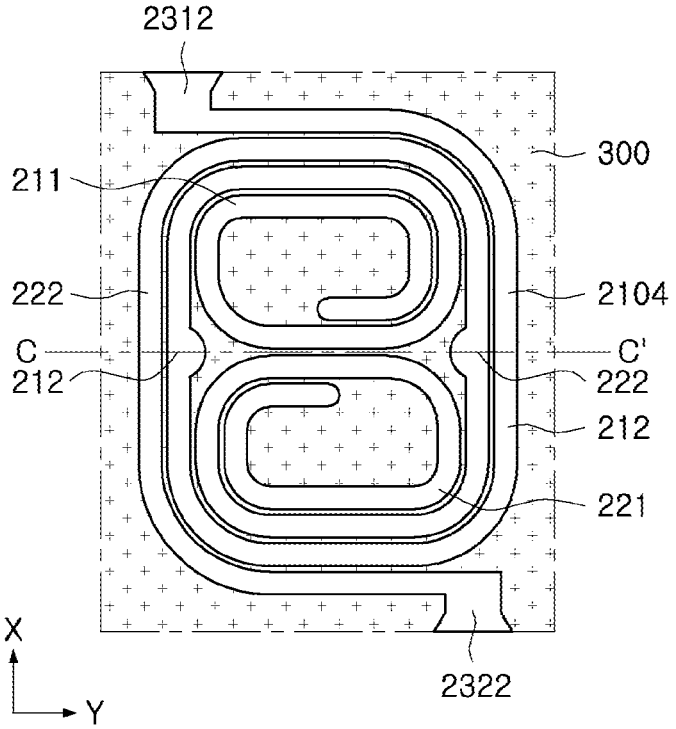
Figure 8B:
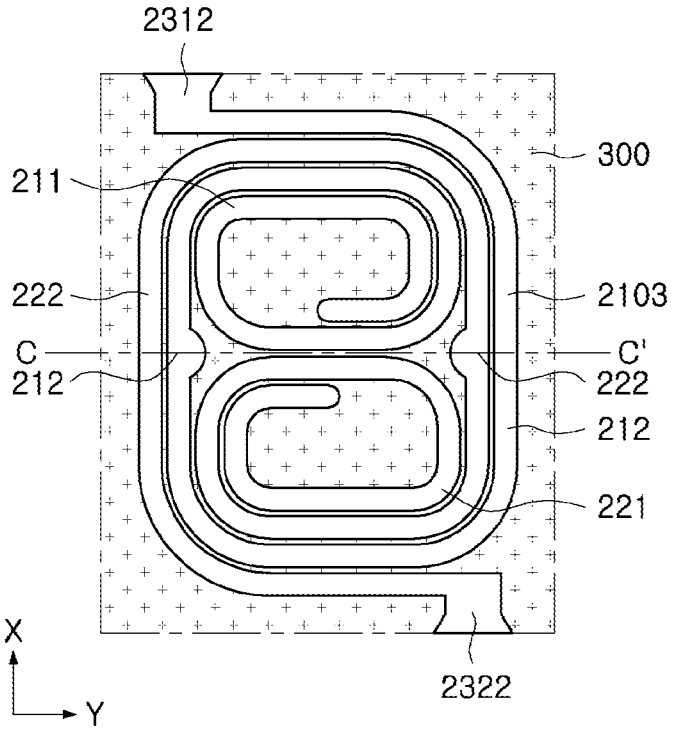

FIG. 5 is a side perspective view schematically illustrating a coil component according to a second exemplary embodiment of the present disclosure. FIG. 6 is a cross-sectional view taken along line II-II' of FIG. 5. FIGS. 7A to 8B are views schematically illustrating the coil portion of FIG. 5.

Referring to FIG. 5, in a coil component 2000 according to this embodiment, line widths of first to four coil layers 2101, 2102, 2103, and 2104 in a region adjacent to spacing portions 3301 and 3302 may be substantially same as each other, compared to the coil component 1000 according to the first embodiment of the present disclosure. Therefore, only the line widths of the first to fourth coil layers 2101, 2102, 2103, and 2104, different from the first embodiment, will be described in describing this embodiment. The remaining configuration of this embodiment may be applied as it is in the first embodiment of the present disclosure. Here, one of ordinary skill in the art would understand that the line widths being 'substantially same' refer to line widths similar to each other with a constant geometrical tolerance.

Referring to FIGS. 5 and 6 to 7B, in each of adjacent regions in first and second extension portions 212 and 222, adjacent to the spacing portions 3301 and 3302, a line width (W2) of each second and fourth coil layers may be equal to a line width (W1) of each first and third coil layers. Specifically, the line width (W2) of the second coil layer 2102, adjacent to the first spacing portion 3301 of the second extension portion 222, may be equal to the line width (W1) of the first coil layer 2101, adjacent to the first spacing portion 3301 of the second extension portion 222. First resists (not illustrated) for forming the first and second coil portions 210 and 220 may be arranged to be spaced apart from a support substrate 100, and the first coil layer 2101 of the first and second coil portions 210 and 220 may be formed between the first resists (not illustrated). In this case, a line width of the first coil layer 2101 may be increased in a region adjacent to the first spacing portion 3301 by disposing a narrower resist than in the first embodiment than in the first embodiment therein. Thereafter, the first resists (not illustrated) may be removed by exposure/development. The second coil layer 2102 of the first and second coil portions 210 and 220 may be formed on a side portion of the first coil layer 2101 without separately disposing a second resist. In this embodiment, since the line width (W1) of the first coil layer 2101 may be increased than in the first embodiment, although the first coil layer 2101 may be formed by an isotropic plating process and the second coil layer 2102 may be formed by an anisotropic plating process, the line width (W1) of the first coil layer 2101 may be formed to be identical to the line width (W2) of the second coil layer 2102. In this embodiment, for convenience of description, only the method of forming the first and second coil layers 2101 and 2102 is described. The third and fourth coil layers 2103 and 2104, respectively corresponding to the first and second coil layers 2101 and 2102, may be applied.

The present disclosure is not limited by the above-described embodiment and the accompanying drawings, but is intended to be limited by the appended claims.

Therefore, various forms of substitution, modification, and alteration may be made by those skilled in the art without departing from the technical spirit of the present disclosure described in the claims, which may be also within the scope of the present disclosure.

According to the present disclosure, a coil component may effectively control coupling inductance between a plurality of coil portions in a coupled inductor.

In addition, according to the present disclosure, a coil component may improve DC resistance characteristics of components in total by additionally arranging a plurality of coil portions between the plurality of coil portions in a coupled inductor.

While exemplary embodiments have been illustrated and described above, it will be apparent to those skilled in the art that modifications and variations could be made without departing from the scope of the present disclosure as defined by the appended claims.

What is claimed is:

1. A coil component comprising:

a support substrate;

a first coil portion and a second coil portion arranged on the support substrate and spaced apart from each other; and a body having a first core and a second core spaced apart from the first core, wherein the first and second coil portions comprise a first coiled portion and a second coiled portion that include at least one turnabout the first and second cores, respectively, and a first extension portion and a second extension portion extending from the first and second coiled portions, respectively, the first and second extension portions each surrounding the first and second cores, the body further comprises spacing portions, facing each other, defined between the first coiled portion and the second coiled portion and spaced apart from the first and second cores, and in the first and second extension portions, a line width of each of adjacent regions adjacent to the spacing portions is greater than a line width of a region except the adjacent regions.

2. The coil component according to claim 1, wherein the spacing portions comprise:

a first spacing portion surrounded by the first coiled portion, the second coiled portion, and the second extension portion, and a second spacing portion surrounded by the first coiled portion, the second coiled portion, and the first extension portion.

3. The coil component according to claim 1, wherein each of the adjacent regions in the first and second extension portions protrudes toward a central portion of the body.

4. The coil component according to claim 1, wherein heights of the adjacent regions in the first and second extension portions are equal to each other.

5. The coil component according to claim 1, wherein the first and second coil portions comprise a plurality of straight portions and a plurality of curved portions connecting the plurality of straight portions to each other, and each of the spacing portions is disposed between a curved portion of the first coiled portion and a curved portion of the second coiled portion.

6. The coil component according to claim 1, wherein the body comprises a first surface and a second surface opposing each other, and a first side surface and a second side surface connecting the first surface to the second surface and opposing each other, the first coil portion further comprises a first lead-out portion exposed through the first side surface of the body, and the second coil portion further comprises a second lead-out portion exposed through the second side surface of the body.

7. The coil component according to claim 6, wherein the first extension portion connects the first lead-out portion to the first coiled portion and surrounds the first and second coiled portions, and the second extension portion connects the second lead-out portion to the second coiled portion and surrounds the first and second coiled portions.

8. The coil component according to claim 6, wherein the first lead-out portion comprises first and second lead-out patterns exposed through the first side surface of the body to be spaced apart from each other, and the second lead-out portion comprises third and fourth lead-out patterns exposed through the second side surface of the body to be spaced apart from each other.

9. The coil component according to claim 1, wherein the support substrate comprises a first surface and a second surface opposing each other, and the first and second coil portions further comprises:

a first coil layer disposed on the first surface of the support substrate, and a second coil layer disposed on the first coil layer and contacting the first coil layer; and a third coil layer disposed on the second surface of the support substrate, and a fourth coil layer disposed on the third coil layer and contacting the third coil layer.

10. The coil component according to claim 9, wherein, in each of the adjacent regions in the first and second extension portions, line widths of the second and fourth coil layers are greater than line widths of the first and third coil layers, respectively.

11. The coil component according to claim 9, wherein, in each of the adjacent regions in the first and second extension portions, line widths of the first to fourth coil layers are substantially same as each other.

12. The coil component according to claim 9, wherein a line width of each of the second and fourth coil layers is greater than a thickness of each of the second and fourth coil layers.

13. A coil component comprising:

a support substrate;

a first coil portion and a second coil portion arranged on the support substrate and spaced apart from each other; and a body having a first core and a second core spaced apart from the first core in a first direction, wherein the first and second coil portions comprise a first coiled portion and a second coiled portion that include at least one turnabout the first and second cores, respectively, and a first extension portion and a second extension portion extending from the first and second coiled portions, respectively, the first and second extension portions each surrounding both of the first and second cores, each of the first and second coil portions includes first and second coil layers disposed on one surface of the support substrate, the first and second coil layers sequentially disposed from the one surface of the support substrate, a line width of the first and second extension portions at a center region thereof in the first direction is greater than a line width of the first and second extension portions at a region except the center region, and a line width of the second coil layer at said center region is greater than a line width of the first coil layer at said center region.

14. The coil component according to claim 13, wherein the body comprises a first surface and a second surface opposing each other, and a first side surface and a second side surface connecting the first surface to the second surface and opposing each other, the first coil portion further comprises a first lead-out portion exposed through the first side surface of the body, and the second coil portion further comprises a second lead-out portion exposed through the second side surface of the body.

15. The coil component according to claim 13, wherein each of center regions of the first and second extension portions in the first direction protrudes toward a central portion of the body.

16. The coil component according to claim 13, wherein heights of center regions of the first and second extension portions the first direction are equal to each other.

17. A coil component comprising:

a support substrate;

a first coil portion and a second coil portion arranged on the support substrate and spaced apart from each other; and a body having a first core and a second core spaced apart from the first core, wherein the first and second coil portions comprise a first coiled portion and a second coiled portion that include at least one turnabout the first and second cores, respectively, and a first extension portion and a second extension portion extending from the first and second coiled portions, respectively, the first and second extension portions each surrounding the first and second cores, each of the first and second coil portions includes first and second coil layers disposed on one surface of the support substrate, the first and second coil layers sequentially disposed from the one surface of the support substrate, a line width of the first and second extension portions at a center region thereof in the first direction is greater than a line width of the first and second extension portions at a region except the center region, and a line width of the second coil layer at said center region is substantially same as a line width of the first coil layer at said center region.

18. The coil component according to claim 17, wherein the body comprises a first surface and a second surface opposing each other, and a first side surface and a second side surface connecting the first surface to the second surface and opposing each other, the first coil portion further comprises a first lead-out portion exposed through the first side surface of the body, and the second coil portion further comprises a second lead-out portion exposed through the second side surface of the body.

19. The coil component according to claim 17, wherein each of center regions of the first and second extension portions the first direction protrudes toward a central portion of the body.

20. The coil component according to claim 17, wherein heights of center regions of the first and second extension portions the first direction are equal to each other.

* * * * *